US005351845A

United States Patent [19]

Hunter

[11] Patent Number: 5,351,845

[45] Date of Patent: Oct. 4, 1994

[54] COGNITIVE SKILL BASED CHILD-RESISTANT AND TAMPER-EVIDENT CLOSURE

[75] Inventor: Robert M. Hunter, Bozeman, Mont.

[73] Assignee: Yellowstone Environmental Science, Inc., Bozeman, Mont.

[21] Appl. No.: 828,716

[22] Filed: Jan. 31, 1992

Related U.S. Application Data

[63] Continuation-in-part of Ser. No. 437,656, Nov. 15, 1989, which is a continuation-in-part of Ser. No. 339,819, Apr. 18, 1989, Pat. No. 4,991,729.

[51] Int. Cl.[5] ..... B65D 55/02

[52] U.S. Cl. ..... 215/225; 215/204; 215/224; 215/230

[58] Field of Search ..... 215/201, 203, 204, 206, 215/208, 224, 225, 230

[56] References Cited

U.S. PATENT DOCUMENTS

| | | | |
|---|---|---|---|
| 446,657 | 2/1891 | Baum . | |
| 841,668 | 1/1907 | Cowles . | |
| 3,033,406 | 5/1962 | Sauber . | |
| 3,129,834 | 4/1964 | Kimball | 215/206 |
| 3,405,828 | 10/1968 | St. Pierre . | |
| 3,407,954 | 10/1968 | Millis . | |
| 3,421,347 | 1/1969 | Sotory . | |
| 3,445,021 | 5/1969 | Johnson . | |
| 3,656,647 | 4/1972 | Swinn | 215/208 |
| 3,669,296 | 6/1972 | Drew et al. . | |
| 3,684,117 | 8/1972 | Leopoldi et al. . | |
| 3,843,007 | 10/1974 | Meyer . | |
| 3,850,324 | 11/1974 | Meyer . | |
| 3,871,544 | 3/1975 | Peyser | 215/225 |
| 4,433,790 | 2/1984 | Gibson | 215/246 |
| 4,524,876 | 6/1985 | Kusz | 215/224 |
| 4,573,598 | 3/1986 | Perry | 215/204 |
| 4,782,963 | 11/1988 | Hunter | 215/206 |
| 4,984,700 | 1/1991 | Knickerbocker | 215/251 |
| 4,991,729 | 2/1991 | Hunter | 215/206 |
| 5,017,128 | 5/1991 | Hunter . | |
| 5,085,578 | 2/1992 | Hunter . | |
| 5,097,974 | 3/1992 | Rozenberg | 215/225 |
| 5,184,376 | 2/1993 | Hunter . | |

*Primary Examiner*—Allan N. Shoap
*Assistant Examiner*—Vanessa Caretto

[57] ABSTRACT

A generally cylindrical relative rotatable lock structure comprises three relatively rotatable coaxial members. The first and second members have generally opposed surfaces carrying connecting means which interengage to prevent relative axial movement between those members except in predetermined relatively rotatable positions. The third member is supported by one of the first or second members to prevent axial movement relative to the supporting member, but to permit rotatable movement. Friction between the third and non-supporting member causes the third member to rotate with the non-supporting member. The third member has connecting means cooperable with the connecting means on the member which does not support the third member to prevent relative axial movement between the third and non-supporting members except in predetermined relative position. Opposing stop members are provided on the third member and the supporting member limiting their relative rotation in one direction to less than one revolution before the stop faces abut after which the third member is driven by the stop member to rotate with the supporting member. However, at least one of the stop members has a ramp on the face opposed to the stop face of such a pitch that the other stop member, upon encountering the ramp, is able to ride up the ramp and over the stop member during relative rotation in the direction opposite to that causing contact between the stop faces. The principal use of the invention is as a closure for child-resistant packaging.

7 Claims, 8 Drawing Sheets

COGNITIVE SKILL BASED CHILD-RESISTANT AND TAMPER-EVIDENT CLOSURE

This invention was made with United States (U.S.) Government support under Grant No. 5 R44 HD24009-03 awarded by the National Institute of Child Health and Human Development. The U.S. Government has certain rights in the invention.

This application discloses inventions that were discovered during research funded by the United States Department of Health and Human Service—National Institute of Child Health and Human Development (NICHD) under the Small Business Innovative Research (SBIR) Program. Aspects of the invention were introduced in a report entitled "Cognitive Skill Based Child-Resistant Medicine Container" prepared for the NICHD by Yellowstone Environmental Science, Bozeman, Mon., January, 1989, under a Phase I SBIR grant.

The present application is a continuation in part of copending application Ser. No. 07/437,656 filed Nov. 15, 1989, and entitled TECHNIQUE FOR RENDERING PACKAGING CHILD-RESISTANT, which is a continuation in part of application Ser. No. 339,819, filed Apr. 18, 1989, now U.S. Pat. No. 4,991,729 granted Feb. 12, 1991, entitled ELDER-ACCESSIBLE CHILD-RESISTANT PACKAGING.

The present invention relates to structures capable of rendering closures child resistant and tamper evident while maintaining ease of adult use. In particular, the present invention relates to structures that make combination lock closures sufficiently child resistant to provide adequate protection of child health yet not so complex as to be uneconomical or excessively inconvenient for adults. The term "closure" is used herein in accordance with its dictionary definition of "something that closes." Similarly, the term "close" is also used in accordance with its dictionary definition of "to put (something) in a position to obstruct an entrance, opening, etc." or "to stop or obstruct (a gap, entrance, aperture, etc.)" or "to block or hinder passage across; prevent access to." The best mode of the invention involves closures on child-resistant packaging but the invention is applicable to any child-resistant feature that prevents access to something that is capable of being enclosed. Thus, the child-resistant closure structure disclosed herein could also be used to prevent access to the operating mechanism of child-resistant lighters and child-resistant safety belt buckles or other devices.

THE STATE OF THE ART

A child-resistant closure is essentially a locked closure having a "key" that adults possess and children do not. Most child-resistant packaging (CRP) on the market today relies on "locking" closures that have both cognitive skill and strength or dexterity based "keys". Generally, older adults find this type of CRP to be difficult to use. Other types of CRP utilize actual keys, but are less practical.

CRP with locking closure mechanisms that do not rely on actual keys or on presumed strength or dexterity differences between children and adults are also possible. These types of child-resistant closures are cognitive skill based, that is, they rely on cognitive skills that adults possess and children under the age of five do not, e.g., problem-solving skills. Cognitive skill based CRP closures proposed to date rely on combination lock mechanisms, maze (or labyrinth) closures, dual (or reverse) thread closures or a combination of these technologies.

Combination lock closure mechanisms appropriate for providing child resistance for packages are of two basic types. With one type, the mechanical elements that maintain the locked condition are directly manipulated (actually touched) by the user. The puzzle-lock (also known as the letter-lock or ring-lock) is the classic example of this type.

With the second basic type of combination lock, at least some of the mechanical elements that maintain the locked condition are manipulated indirectly. With this type of lock, only one locking element need be directly moved and it, in turn, moves (usually rotates) either one (directly) or all (some indirectly) of the other locking elements (usually tumblers).

The second type of cognitive skill based CRP closure is the maze closure or dual thread closure. With this type of closure, two types of motion are required for closure unlocking: (1) rotation and (2) linear (usually axial) motion. The sequence of steps required to unlock the closure typically consists of alternating rotations with axial motions. True combination lock closures can be differentiated from maze and dual thread closures in that unlocking of combination lock closures requires only one type of motion, e.g., rotation or linear motion. Combination lock closures that rely on rotation(s) for unlocking may allow axial motion between the closure cap and the container prior to unlocking, but this second type of motion does not cause (and may even prevent, in some designs) unlocking of the closure mechanism.

A significant limitation of maze closures and dual thread closures has been their loss of oxygen and moisture exclusion and (liquid, powder or granule) content inclusion capabilities upon partial opening. Another problem with dual thread closures is that they are reportedly not very difficult for children to open. A third limitation of the dual thread closures is that opening them requires an action (unscrewing a left hand thread) that is unfamiliar to adults and that, in fact, goes against decades of experience in how a threaded closure is opened.

Child-resistant packaging designs having combination lock closures of the first type have been disclosed by a number of inventors. U.S. Pat. Nos. disclosing such inventions include those issued to Baum (446,657), Cowles (841,668), Sauber (3,033,406), Kimball (3,129,834), St. Pierre (3,405,828), Millis (3,407,954), Sotory (3,421,347), Johnson (3,445,021), Drew et al. (3,669,296), Leopoldi et al. (3,684,117), Meyer (3,843,007) and Meyer (3,850,324). These closure designs have not achieved commercial success because they are too complex. They generally comprise multiple movable parts and, as a consequence, have a higher manufacturing cost and present a higher level of complexity to the user.

Under current and proposed regulations of the U.S. Consumer Product Safety Commission (CPSC), child-resistance effectiveness (CRE) and older adult use effectiveness (OAUE) of CRP closure designs are measured using standard test protocols. CRE is measured by asking pairs of children in a specified age group (generally under five years of age) to attempt to open the package closure in specified time periods both before and after a nonverbal demonstration. The CRE is the fraction (proportion) of children in the group (expressed as a percentage) that is unable to open the package. OAUE is measured by asking individual adults in a specified age group (typically 60–75 years) to open and close the package using the instructions supplied with it within a specified time period. The OAUE is the fraction (proportion) of adults in the group (expressed as a percentage) that is able to open and close the package.

Thus, in the United States, CRP must meet specified government standards for child resistance effectiveness and adult use effectiveness. Moreover, these criteria are subject to change over time. Prior art combination lock CRP closure designs were not based on a technique for rendering packaging child resistant that allowed cost-effective compliance with current and proposed CPSC regulations.

Five prior art patents by the present inventor (U.S. Pat. Nos. 4,782,963, 4,991,729, 5,085,578, and 5,017,128, 5,184,376) the contents of which five patents are fully incorporated herein as if actually set forth,illustrate combination lock mechanisms and structures that could be dimensioned as disclosed herein to provide an appropriate child resistance effectiveness (CRE) and older adult use effectiveness (OAUE ). These patents and the report referenced above do not, however, teach how to dimension and configure the combination lock mechanisms and structures in the manner disclosed herein.

The present invention was discovered during a Phase II SBIR project. This invention was made with Government support under Grant No. 5 R44 HD24009-03 awarded by the National Institutes of Health. The Government has certain rights in the invention.

THE NATURE OF THE PRESENT INVENTION

The present invention provides structures capable of rendering closures child resistant and tamper evident while maintaining ease of adult use and low cost of manufacture. The technique can be applied to closures whose use requires adults to perform a simple combination of moves to either remove the closure or otherwise gain access to container contents or operate an operating mechanism.

Such closure designs rely for their effectiveness on cognitive skill differences between young children and adults. They pose a problem that adults can solve and that young children cannot. Young children typically do not use the "scientific method" in solving problems, that is, they do not generate and test hypotheses related to solution of the problems they face. In fact, the problem-solving behavior of young children exhibits a "win-shift" pattern. A child will attempt incorrect "solutions" repeatedly and only shift to a correct solution after it is found by accident. This type of problem-solving behavior is consistent with a "zero-memory assumption" in that young children act as if they do not remember that a particular "solution" is incorrect. Thus, child-resistance can be provided by presenting a young child with a problem having many incorrect "solutions" and only one correct one. Optimally, the incorrect "solutions" have a similar appearance to the correct solution.

CRP can be configured to exploit this opportunity by designing the package closure means along the line of a combination lock mechanism having a known index of random opening. This allows the closure to be designed to provide a measurable degree of resistance to opening by essentially random manipulations of the closure. Closure designs can be optimized by reducing closure complexity (and, therefore, cost) to the minimum level required to meet government regulations for child resistance or market demands. Furthermore, closure designs can be optimized by providing a level of complexity that does not reduce elder accessibility below acceptable levels.

In its broadest sense, the invention is a structure capable of rendering children resistant an enclosure having a combination lock closure mechanism, the structure being designed by selecting an appropriate level of child resistance, using the selected level of child resistance to determine an index of random opening with which it correlates, and configuring a closure mechanism with the determined index of random opening. The closure mechanism comprises fastening means on a container part and fastening means on a closure part and one or more tumblers movably attached to one of the two parts.

Structures which could be configured and dimensioned in the manner disclosed herein are disclosed in U.S. patent application Ser. Nos. 07/437,656, 07/592,577 and 07/828,716, the contents of which are incorporated herein as if actually set forth.

The best mode involves selection of a level of child resistance that provides a CRE and an OAUE equal to that required by government regulations. Currently, in the United States regulations of the CPSC require a CRE of 85 percent before a demonstration and 80 percent after one. An OAUE of 90 percent has been proposed.

Analysis of the findings of research described in the document first referenced above, research conducted during a Phase II SBIR project and research conducted by the CPSC shows that correlations exist between a variable herein termed the index of random opening (IRO) of a closure and its CRE and between the IRO of a closure and its OAUE. The present invention is disclosed hereinafter by first describing the general configuration, structure and mode of operation of a CRP design having a combination lock closure and then explaining the technique used to further configure and dimension the closure using the findings of the above research to optimally provide CRE and OAUE. While the preferred mode of combination lock closure comprises the second basic type of combination lock described above, the method is applicable to both basic types. This patent teaches how to dimension (i.e., configure) the various structural parts of the closure combination lock mechanism so as to produce a child-resistant, yet elder-accessible closure.

It is an object of the invention to provide structures for rendering a closure child resistant and tamper evident. It is a further object of the invention to provide a technique for rendering closures child resistant while maintaining ease of adult use and economy. It is a further object of the invention to render CRP closures child-resistant and capable of meeting U.S. Pharmacopeia "tight container" requirements for permeation of water vapor. Further objects and advantages of my invention will become apparent from a consideration of the drawings and ensuing description of it.

DRAWINGS SHOWING PREFERRED EMBODIMENT OF THE INVENTION

FIG. 1 is a side (elevational) view of a container and a closure cap supporting a relatively rotatable member with the closure cap removed and spaced from the container;

Fig. 1*a* is an elevational view of only the top part of an alternative embodiment of the container only from the opposite side;

DETAILED DESCRIPTION OF THE DRAWINGS

Figure 1:
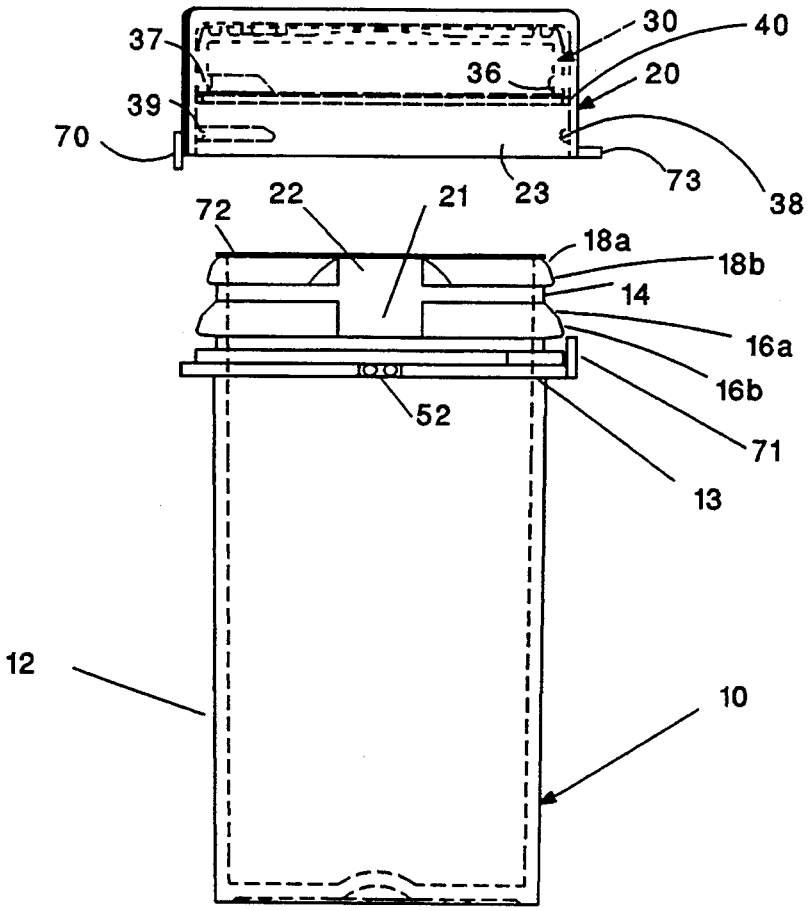
Figure 1A:
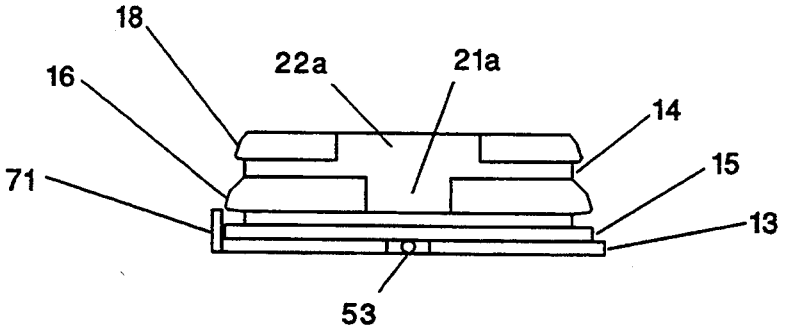
Figure 2:
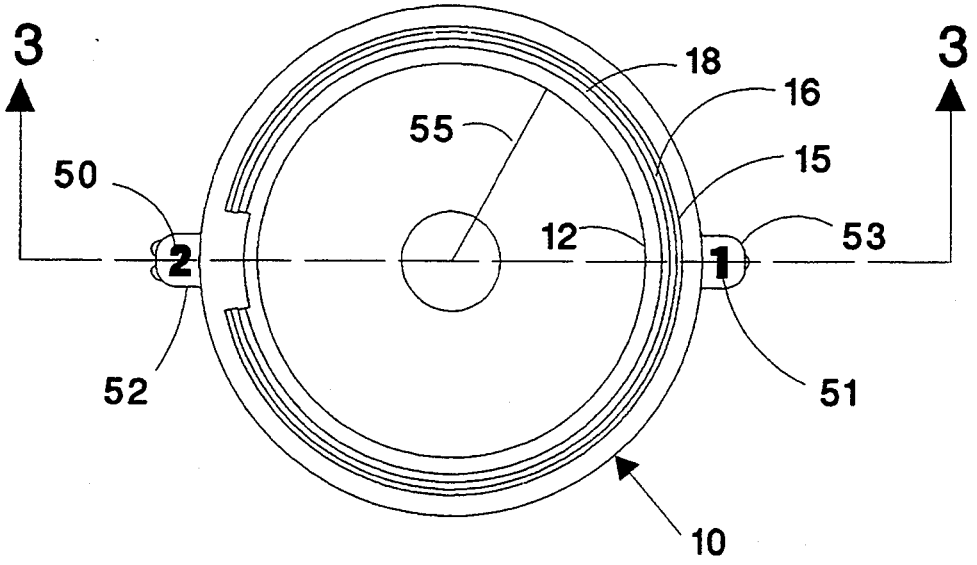
FIG. 2 is a top (plan) view of the container of FIG. 1.
Figure 3:
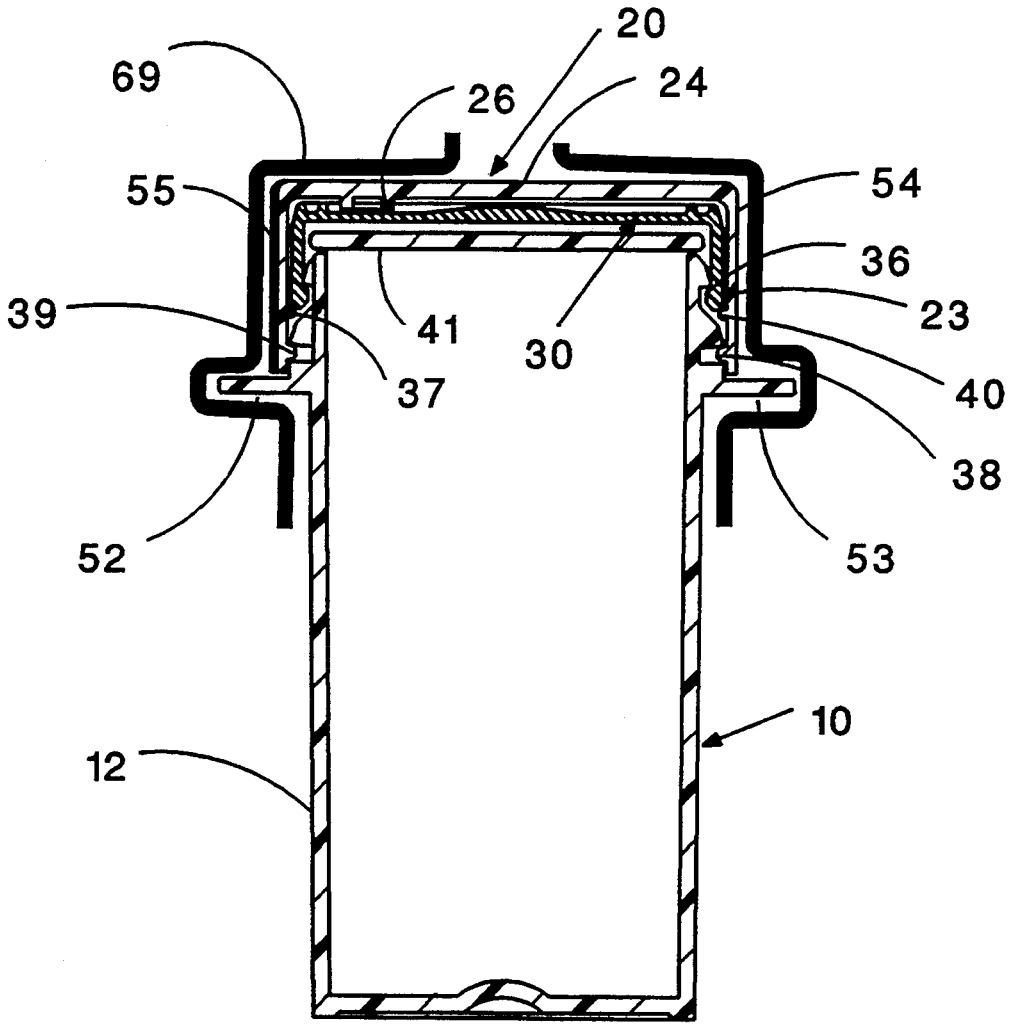
FIG. 3 is a sectional view taken along line 3—3 of FIG. 2 with the closure cap of FIG. 1 also shown in section and also with a shrink-wrap protective cover in place over the combination lock portions of the container and closure.

Referring to FIGS. 1, 1*a*, 2, and 3, there is illustrated a container, generally designated 10, for example, a pill bottle. The body portion of the container may be blow molded, injection molded, machined or otherwise conventionally fabricated of moldable resinous material. Alternatively, it may be molded from glass, or machined or otherwise fabricated of another material. Container 10 may be of any shape and dimensions provided it is terminated in a neck 14 of cylindrical form, through which is provided an open mouth access to the interior of body 12 of the container 10. The term "neck" should not be construed to mean a narrowed portion, although in many structures that will be the form it takes. On the outer surface of neck 14 are molded or otherwise provided fastening means in the form of circumferential ribs 16 and 18. The bottom surface of each of the ribs 16 and 18 is generally flat and is preferably within 10 degrees of being perpendicular to the cylindrical surface of neck 14. Each of the ribs 16 and 18 is provided with a discontinuity or channel 21 and 22 of sufficient width to permit passage of a stud, a cooperating fastening means as described below. Although they may vary in specific geometry and dimensions as well as cross-sectional shape, a preferred cross section shape for the ribs is generally triangular or trapezoidal, perhaps beveled with two slopes 16*a*, 16*b* and 18*a*, 18*b* as seen in FIG. 1. The ribs also increase in axial thickness and in diameter in the direction away from the mouth as shown in FIGS. 1 and 3. In preferred embodiments a shape providing a ramp 16*a*, 16*b* or 18*a*, 18*b* or inclined plane permits the studs of the cap to be snapped over the ribs as the closure cap is placed onto the container. Stepped stop collar 13 located at the lower end of neck 14 provides a stop shoulder generally perpendicular to the cylindrical neck which limits axial movement of the closure studs as seen in FIG. 3 to their locking levels and prevents children from gaining purchase on the lower edge of sidewalls 23 of closure cap 20. Sidewalls 23 of closure cap 20 snugly receive smaller diameter of the stepped outer cylindrical surface of stop collar 13 when closure cap 20 is placed on the container as seen in FIG. 3. The presence of the stepped cylindrical surface 15 prevents closure cap 20 from being squeezed into an oval shape during attempts by children to rip it off the container when it is in the locked condition. Stop collar 13 located below cylindrical surface 15, extends radially outward to limit movement of and access to the bottom edge or lip of closure cap 20 when closure cap 20 is placed on the container.

Figure 5:
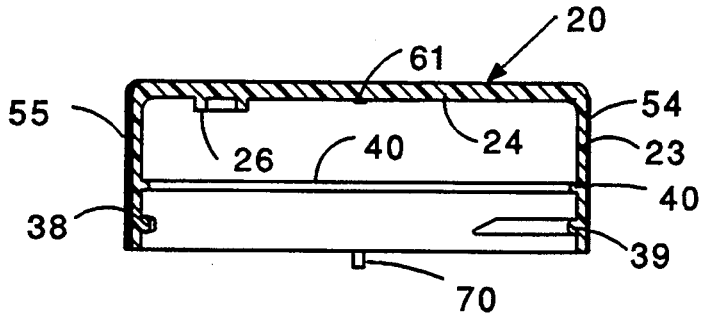
FIG. 5 is a sectional view taken along line 5—5 of FIG.4.
Figure 4:
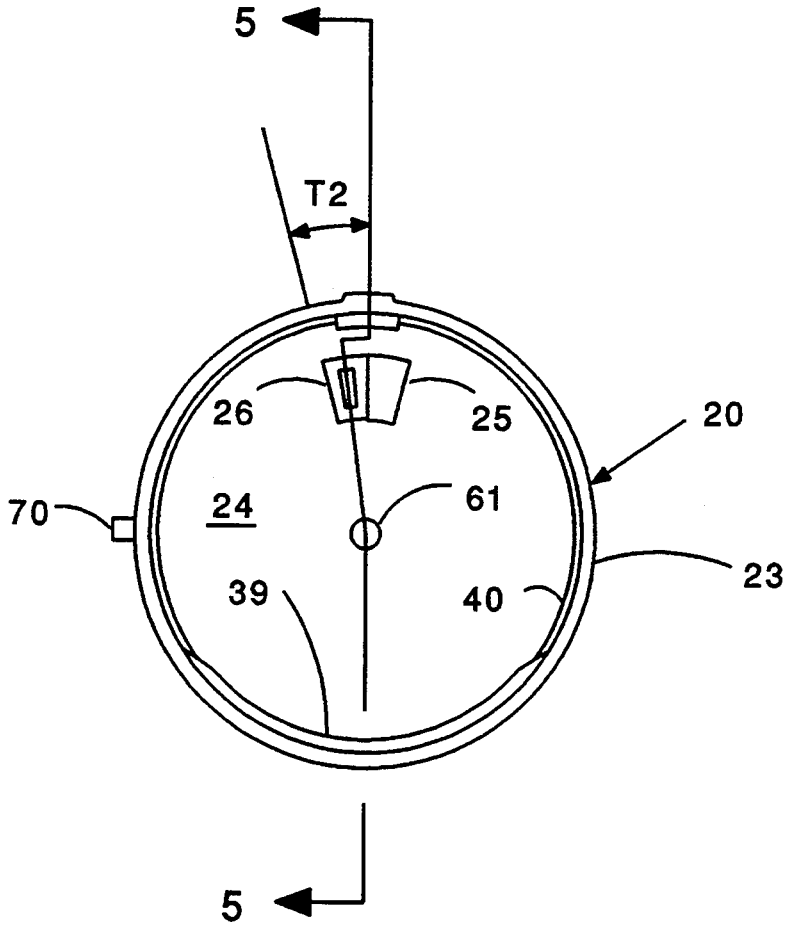
FIG. 4 is a plan view of the closure cap of FIG. 1 from below.
Figure 7:
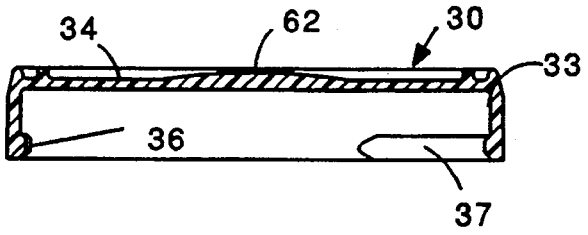
FIG. 7 is a sectional view taken along line 7—7 of FIG. 6.

Considering now the closure cap 20 of FIGS. 1, 4 and 5, the structure includes generally cylindrical sidewalls 23 and closing end wall or top 24 transverse to the sidewalls. Closure cap 20 may be injection molded or machined or otherwise fabricated. Sidewalls 23 provide a generally cylindrical internal surface whose diameter is considerably larger than the neck 14 of the container and at least at the lip snugly conforms to the outer cylindrical surface.

Figure 6:
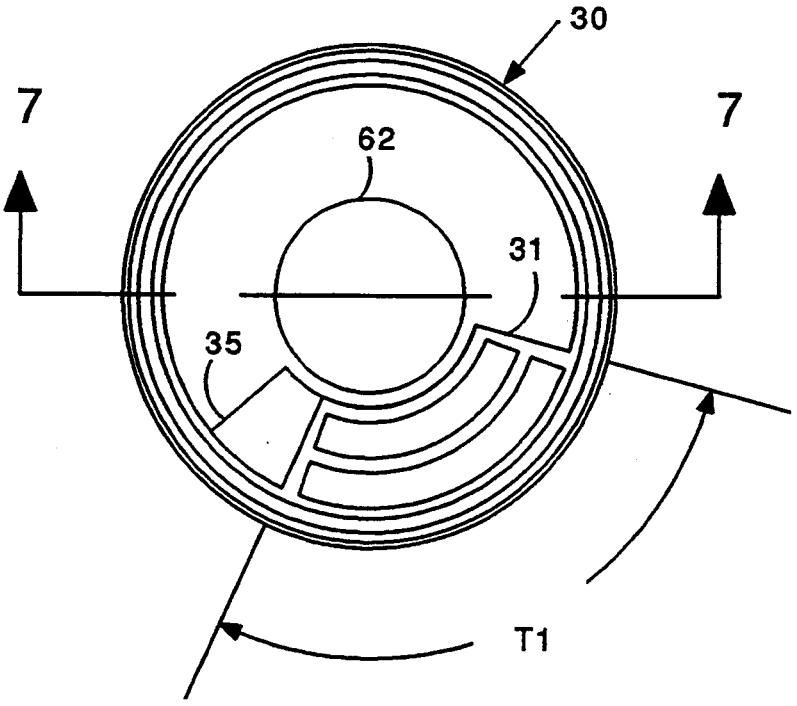
FIG. 6 is a plan view of the top of the relatively movable member of FIG. 1.

Generally cylindrical rotatable member 30 is illustrated in FIGS. 1, 3, 6 and 7. Rotatable member 30 fits within closure cap 20 as seen in FIG. 3 and is supported in position by circumferential retainer ring 40 so as to be rotatable relative to cap 20. Generally cylindrical rotatable member 30 may be injection molded or machined or otherwise fabricated. Rotatable member 30 need not be of the cap configuration shown. It may be of tubular shape for example. Rotatable member 30 as seen in FIG. 6 carries a stop 31 on its outer surface. During rotation stop 31 interacts with interfering stop 26 on closure cap 20 as seen in FIGS. 4 and 5. Stop 26 extends downward from the top 24 of closure cap 20 and, in preferred embodiments, is radially spaced inward from sidewalls 23. Stop 31 extends up from the top 34 of rotatable member 30 offset from the edge at the same general radius at stop 26 so as to make contact with stop 26. As seen FIG. 5, two inwardly projecting studs 38 and 39 are provided on the inner cylindrical surface of sidewall 23 of closure cap 20. Similarly two inwardly projecting studs 36 and 37 are provided on inner wall 33 of rotatable member 30. The studs 36 and 38 are of a width to pass through channels 22 and 21, respectively, and are so positioned on closure walls 23 and rotatable member walls 33 as to lie below ribs 18 and 16 when the lip of the sidewalls 23 contacts stop 13 as the cap is in place over the neck of the container. Studs 37 and 39 preferably are wider circumferentially than studs 36 and 38 and are of a width that cannot pass through channels 22 and 21, respectively. In an alternative embodiment (shown in FIG. 1*a*) having similar channels 21*a* and 22*a* on the opposite side of neck 14, studs 37 and 39 preferably are wider circumferentially than studs 36 and 38 and are of a width that cannot pass through channels 22*a* and 21*a*. In this embodiment, studs 36 and 38 are of a width to pass through channels 22*a* and 21*a*, respectively. Studs 36 and 37 are so positioned on wall 33 as to lie below ribs 18 and studs 38 and 39 are so positioned on wall 23 as to lie below rib 16 when the closure 20 is in place against stop 13. Although they may vary in specific geometry and axial length, as well as cross-sectional shape, at least a portion of the top surfaces of studs 36 and 38 are generally flat. In the best mode, the studs form and dimension permit the studs to be snapped over the ribs as the closure cap is placed onto the container. The essentially flat portion of the top of studs 36 and 38 is generally parallel to the generally flat lower surface of ribs 16 and 18 when the closure cap is placed onto the container. The studs 36 and 38 and ribs 16 and 18 thus comprise a locking snap fastening means.

In practice, the rotatable member 30 is loosely held in the closure cap 20 by the small retainer ring 40 past which the rotatable member is forced in assembly. The loose fit is designed into the structure just as a snug fit is designed between the closure cap and the container. In the best mode, a snug fit is provided by inserting a compressible, disk-shaped liner 41 in the top of rotatable member 30 so that it is compressed between the member and the top edge of the container neck 14 when rotatable member 30 is snapped on container 10 (FIG. 3). Sidewalls 33 are designed to deform in shape and/or circumferential length to provide a snap fit. Other methods of accomplishing such a frictional engagement are disclosed in the inventor's U.S. Pat. Nos. 4,782,963 and 4,991,729. Use of a compressible liner 41 has the effect of tightly closing the container to prevent moisture permeation into the package as well as causing the relatively rotatable member 30 not to rotate with the closure cap but to stay with the body 12 of container 10 during relative rotation until the stops 26 and 31 make contact. At that point, closure cap 20 will drive and rotate rotatable member 30 by means of the stops and against the frictional force.

Figure 8:
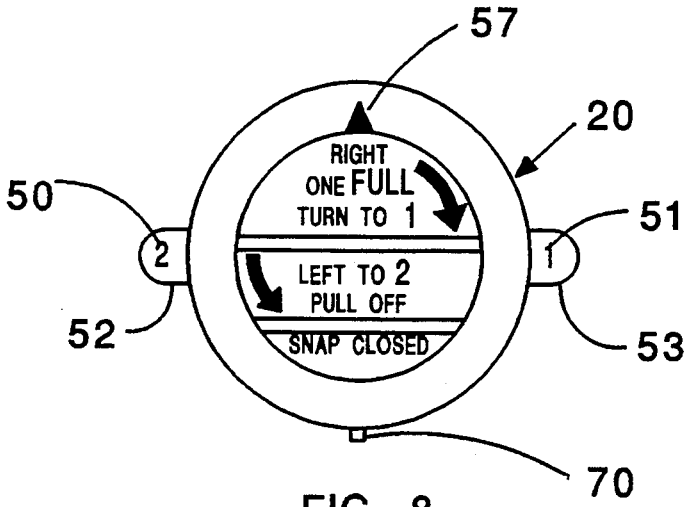
FIG. 8 is a plan view from above of the closure cap assembled on the container.

Assuming that the closure cap is on the container and one wishes to remove it, it is convenient to provide markings on the container and closure cap to enable realignment of the studs and channels. In the embodiment shown on FIG. 2, markings 50 and 51 are printed on tabs 52 and 53 in contrasting color using a relatively large typeface such as Helvetica 12 point. They are shown as the black numerals 1 and 2 on tabs 52 and 53 on container 10 on FIG. 2. An embossed black line 55 on the closure 20 acts as a pointer to the markings 50 and 51. Alternatively, the radially directed arrows 57, 58 and 59 on the closure caps 20 seen in FIGS. 8, 9 and 10 may be used as the pointer. First, closure cap 20 is rotated up to a full rotation clockwise to achieve contact between stops 26 and 31, thereby rotating rotatable member 30 and stopping the arrow at the numeral 1. This aligns stud 36 with channel 22. Then, rotation of closure cap 20 in the opposite (counterclockwise) direction to position 2 will position stud 38 to pass axially through channel 21. In this embodiment, the embossed black line or arrow and the black numeral 1 comprise a first set of marks and the embossed black line or arrow and the black numeral 2 comprise a second set of marks.

Figure 9:
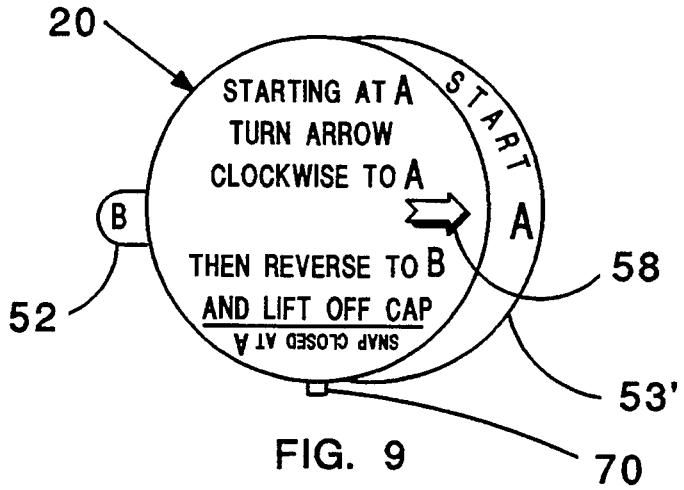
FIG. 9 is a plan view from above of the closure cap having different markings on the container.
Figure 10:
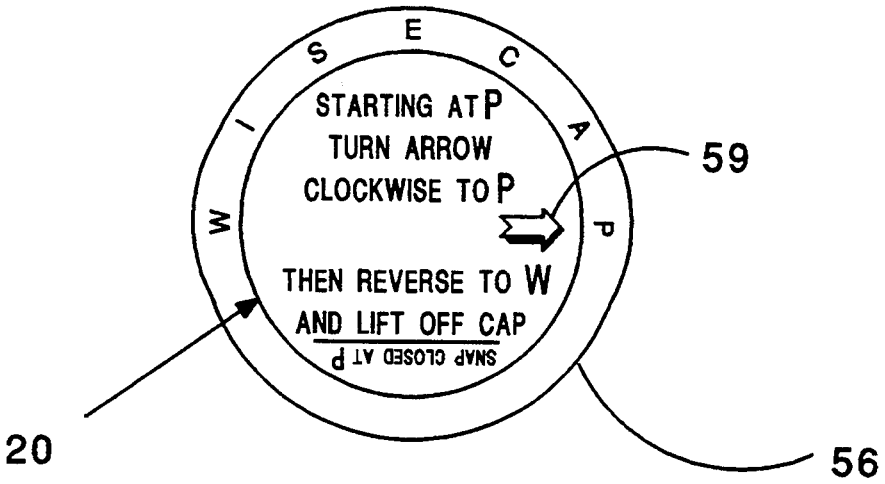
FIG. 10 is a third plan view of the closure cap having different markings on the container.

FIGS. 9 and 10 illustrate preferred modes of marking the container and outer cap. In FIG. 9, on of the tabs 53' is relatively wider and differ from the other in shape. In FIG. 10, a circumferential collar or flange 56 is provided.

FIG. 2 shows rotatable member 30 held in closure cap 20 by retainer ring 40 such that relative axial movement of rotatable member 30 in closure cap 20 is prevented. Similarly, the axial dimensions of the closure cap sidewalls and container neck, as well as the locations of stud 38 and rib 16 are such that axial movement of closure cap 20 is effectively prevented when the closure is in the locked condition. Thus only one type of relative movement, rotation, both of the rotatable member 30 and closure cap 20 relative to container 10 is possible when the closure is locked.

While young children are generally incapable of hypothesis formulation and testing, some of them have learned how to open some conventional closures on both non-CRP and CRP. It is important, therefore, that such opening strategies as simple unscrewing and lifting or pushing down and unscrewing cannot be used to unlock the closure. Because of the "zero memory" phenomenon, it is advantageous that such traditional opening strategies appear to present an opportunity for closure opening to young children.

In the preferred mode, the conventional unscrewing strategy is suggested by providing vertical seriations 54 on the outside surface of the closure cap similar to those provided on conventional continuous threaded closure caps. The unscrewing strategy is thwarted by providing ramps 25 and/or 35 at one end of stops 26 and 31, respectively, whereby closure cap 20 can be configured so as to be capable of driving rotatable member 30 only in the clockwise direction. Should the user attempt to rotate outer cap 20 sufficiently to drive rotatable member 30 in the counterclockwise direction, stop 26 would ride up ramp 35, slide across the top of stop 31 and drop-off the end of stop 31 without rotating rotatable member 30. In this way, only rotation of closure cap 20 relative to container 10 in one direction (clockwise when viewed from the top) is capable of causing rotatable member 30 to rotate relative to container 10. In an alternative embodiment (not shown), at least one ramp is provided only at the other end of stop 25 or 35, thereby allowing rotation of rotatable member 30 in a counterclockwise direction only.

A strategy of simultaneous turning and lifting is thwarted by ensuring that when the closure is locked, studs 38 and 39 on closure cap 20 transfer an upward axial force applied to the closure cap to the container primarily directly to circumferential rib 16 instead of indirectly through ring 40 to rotatable member 30 and thence to rib 18. This is accomplished by choosing the axial locations of ribs 16 and 18, studs 36, 37, 38 and 39 and ring 40 such that, when an upward axial force is applied to closure cap 20 when it is on container 10 and locked, that the axial force is primarily resisted by closure cap 20 fastening means, first circumferential rib 16 and studs 38 and 39.

The "push and turn" opening strategy is thwarted by retaining rotatable member 30 in closure cap 20 between retaining ring 40 on inside sidewall 23 of closure cap 20 and pivots 61 and 62 located on the axis of rotation of rotatable member 30 and closure cap 20. Pivot 61 is provided on the inside surface of the top of closure cap 20. Pivot 62 is provided on the outside surface of the top of rotatable member 30. In an alternative embodiment, only one of the two pivots is provided. A single pivot would have to be longer axially to accomplish the same function. By providing at least one pivot, when downward axial force is applied to closure cap 20 when it is on container 10, the axial force is primarily transferred to the rotatable member 30 in the vicinity of the axis of rotation of rotatable member 30 and distant from its sidewalls. In this way, concurrent downward axial force and rotation of closure cap 20 is ineffective in causing rotatable member 30 to rotate until stops 26 and 31 are properly engaged.

Tamper-resistance may be provided in a variety of ways. In one embodiment, a tubular shrink-wrap 69 film is applied to the package after closure cap 20 is installed and locked. The tube extends under collar 13 and over the top 24 of closure cap 20. In another embodiment, an inner seal 72 comprising heat sealable polyester film and aluminum foil is bonded to the mouth of container 10 prior to installation of closure cap 20. Electromagnetic induction is used to activate the heat sealable film thereby bonding both seal components to the container mouth. In the preferred mode, shown in FIGS. 1 and 4, a snap-off tab 70 is molded on the outer sidewall of closure cap 20. During the first unlocking of the closure, rotation of closure cap 20 causes tab 70 to break off upon impact with either tab 52 or 53 (FIG. 2). Absence of tab 70 can reveal tampering in that it reveals that the closure has been unlocked after final assembly. In an alternative embodiment, also shown in FIG. 1*a* snap-off tab 71 protrudes upward from collar 13 of the container at the outer edge of the side wall of closure cap 20. Upon rotation of closure cap 20, a pointer 73 extending radially outward from the base of the cap, a variation of embossed pointer 57 in FIG. 8, of example, extending outward radially from at least the base of the sidewall of closure cap 20 breaks off the snap-off tab 71 upon impact.

Combination lock closure mechanisms can be unlocked either by random or systematic attempts to try different combinations of relative orientations of closure structural elements. Combination lock mechanisms used on prior art Child-resistant closures typically present the adult user with a straight-forward number of possible combinations for unlocking the closure. They usually did this by providing a single index mark on the cap and a plurality of numbers or letters on each tumbler. The closure was unlocked by aligning an appropriate number or letter on each tumbler with the single index mark. Rotation of a tumbler to a position wherein the single index mark was not aligned with a number or letter on the tumbler was not an option for unlocking the closure.

The combination lock closure mechanisms disclosed in the inventor's above-referenced patents and in FIGS. 1–7 do not present the adult users with a straight-forward, discrete number of possible combinations. This is the case because closure cap 20 and rotatable member 30 act as tumblers and the relative direction of the tumbler rotations is significant, which is not true with puzzle-lock type designs.

Because young children are generally incapable of making systematic attempts to try different combinations, both closures having a discrete number of possible combinations and those that do not can be analyzed to assess the potential unauthorized opening by a child. For the purposes of this disclosure, the potential for unauthorized opening by a child is related to an index termed the index of random opening (IRO). The IRO of any combination lock mechanism may be estimated in a similar manner. In general, the IRO of a CRP closure is the product of the individual indices that each tumbler could be randomly moved to its unlocked position. The index that an individual tumbler could be randomly moved to its unlocked position is the index that its fastening means could be randomly moved to the unlocked position for that tumbler. This index is generally calculated by multiplying the placement quotient by the direction quotient. The placement quotient is estimated by dividing the number of possible positions that a tumbler can take and be in the unlocked condition by the total possible positions for that tumbler. The direction quotient is 1.0 if the direction the tumbler is moved is unimportant. If the direction is important, it is calculated by dividing the number of correct directions by the total possible directions it can be moved. An estimate of the index is calculated for the embodiment disclosed herein by multiplying the following: (1) the index that the center of the stud(s) on each movable part (i.e., tumbler) could be randomly placed within the "effective width" of a channel and (2) the index that each tumbler could be randomly rotated in the correct direction.

The first index is estimated for each tumbler by dividing the total combined "effective widths" of the channels by the interior circumference of the tumbler. The "effective width" for each channel is calculated by subtracting the stud width (SW) from the total channel width (TCW). The second index is estimated by dividing the number of correct directions the closure cap should be rotated (typically one) by the total number of directions the closure cap could be rotated (usually two). The above are determined for each tumbler, i.e., each movable part having channels requiring alignment for the closure to be unlocked, and then all indices so estimated are multiplied.

For a two-part, "nested" closure cap similar in design to that illustrated in FIGS. 1 through 7, the overall formula then calculates the index of a random opening (IRO) is as follows:

$$IRO=[(TCW-(N*SW_1))/(\pi*D_1)]*[(TCW-(N*SW_2))/(\pi-T/2)*D_2]$$

where TCW is the total channel width of all channels combined, N is the total number of channels, $SW_1$ is the width of the stud on the rotatable member, $D_1$ is the inside diameter of the rotatable, $SW_2$ is the width of the stud on the closure cap, $D_2$ is the inside diameter of the closure cap, and T is the angle in radians of the restricted portion of the closure cap. If there is no additional restriction, then T should equal the angle T1 (in radians) corresponding to the angular width of stop 31 in the rotatable member plus the angle T2 (in radians) corresponding to the angular width of stop 26 in the closure cap. With the use of means that effectively eliminate the angular width of the stops, such as ramps 25 and 35, T is equal to zero.

It should be noted that, if T is sufficiently small, more than one rotation of closure cap 20 relative to container 10 may be required to align index stud 36 with channel 22. This would occur only if closure cap 20 were rotated in the wrong direction initially during an opening attempt. Because multiple rotations of a closure cap are inconvenient to older adults with limited wrist flexibility, it is advantageous to limit the normal amount that closure cap 20 can rotate relative to rotatable member 30. This can be accomplished by configuring the interfering stops such that not more than one rotation of closure cap 20 in the correct (designated) direction is necessary to align index stud 36 with channel 22. In the preferred mode, a total angular width of the stops of about 115 degrees accomplishes this goal.

If the direction of one tumbler rotation is important, then a factor of 0.5 is introduced. For example, a closure design with a 2.0 inch diameter closure cap (which is a first tumbler and cap element) with one 1.5 inch diameter rotatable member (which is a second tumbler and cap element), 0.25 inch wide studs (one on each tumbler), 0,375 inch wide channels (one on each tumbler), and only one correct direction for the second rotation, the index of random opening is as follows:

$$(0.125/4.712)(0.125/6.283)(0.5)=0.000264$$

Research conducted by the CPSC, research described in the report referenced above and research conducted subsequently by the inventor have shown that there are approximate correlations between the calculated IRO of a combination lock CRP closure and its CRE (child-resistance effectiveness) and between its IRO and its OAUE (older adult use effectiveness). Approximate correlations between IRO and CRE and between IRO and OAUE are presented in FIGS. 11 and 12, respectively. The data pairs used to develop the correlations are based on measurements of closure dimensions (IRO) and actual testing of packages on panels of 42 to 51 month old children (for CRE) and on panels of 60 to 75 year old adults (for OAUE). The IRO estimates are assumed to be exact because the packages were generally injection molded using the same mold or otherwise fabricated to the same dimensions. For CRE, the data pairs reflect cumulative test results for the indicated number of subjects in a panel, "n", during a standard ten-minute test (after demonstration). For OAUE, the data pairs reflect the results for the indicated number of subjects in a panel, "n" a standard five-minute test with no demonstration.

| | Child test results | | |
|---|---|---|---|
| IRO | CRE, % | n | Error bar, % |
| 0.0876 | 44 | 250 | ±6.1 |
| 0.000968 | 88 | 100 | ±3.2 |
| 0.000556 | 100 | 20 | ±0 |

| | Older adult test results | | |
|---|---|---|---|
| IRO | OAUE, % | n | Error bar, % |
| 0.0876 | 100 | — | ±0 |
| 0.000968 | 98 | 50 | ±3.9 |
| 0.000556 | 95 | 20 | ±9.6 |

The error bars on CRE and OAUE values (which are proportions) each reflect 1.96 times the standard errors of those proportions. The standard errors are approximately equal to the standard deviation of a normally distributed sample statistic. Thus, 95 percent of sampling results would be expected to fall within the range indicated by error bars.

As more data on CRE and OAUE are correlated with the calculated IRO of such closures, closure engineers will be able to more accurately predict the CRE and OAUE ratings of cognitive skill based CRP designs in advance of protocol testing. This will enable such engineers to more efficiently optimize CRP closure designs in response to changes in government regulations or the demands of the market. The correlations shown in FIGS. 10 and 11 can, however, be used at present to determine an index of random opening that provides at least a selected CRE and/or at least a selected OAUE.

Figure 11:
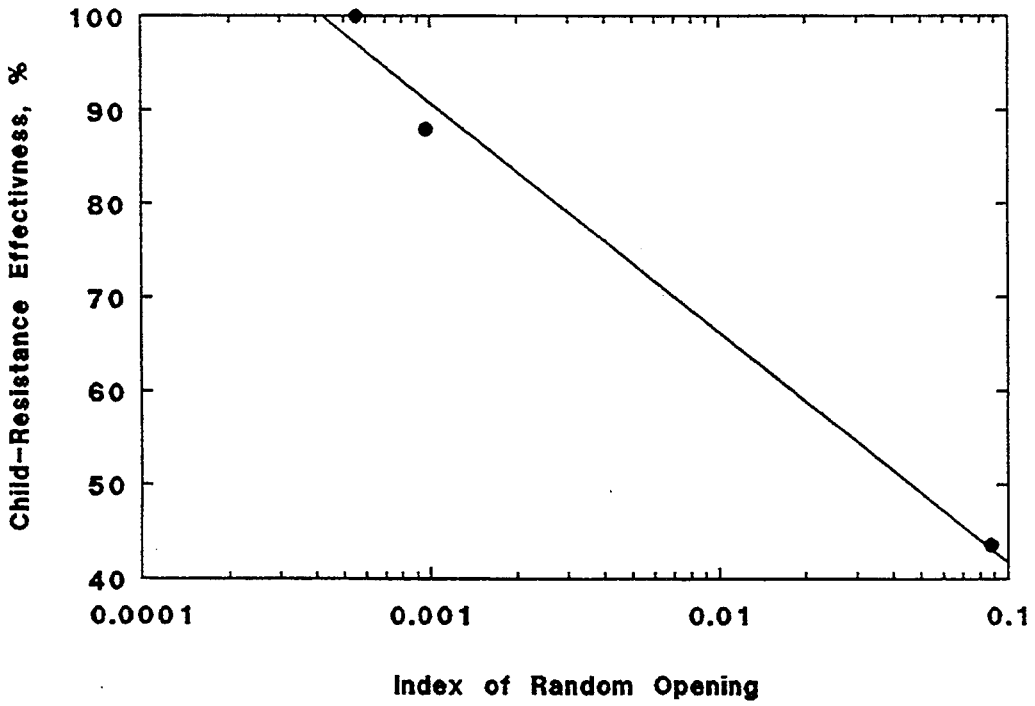
FIG. 11 is a graph which illustrates the correlation between IRO and CRE.
Figure 12:
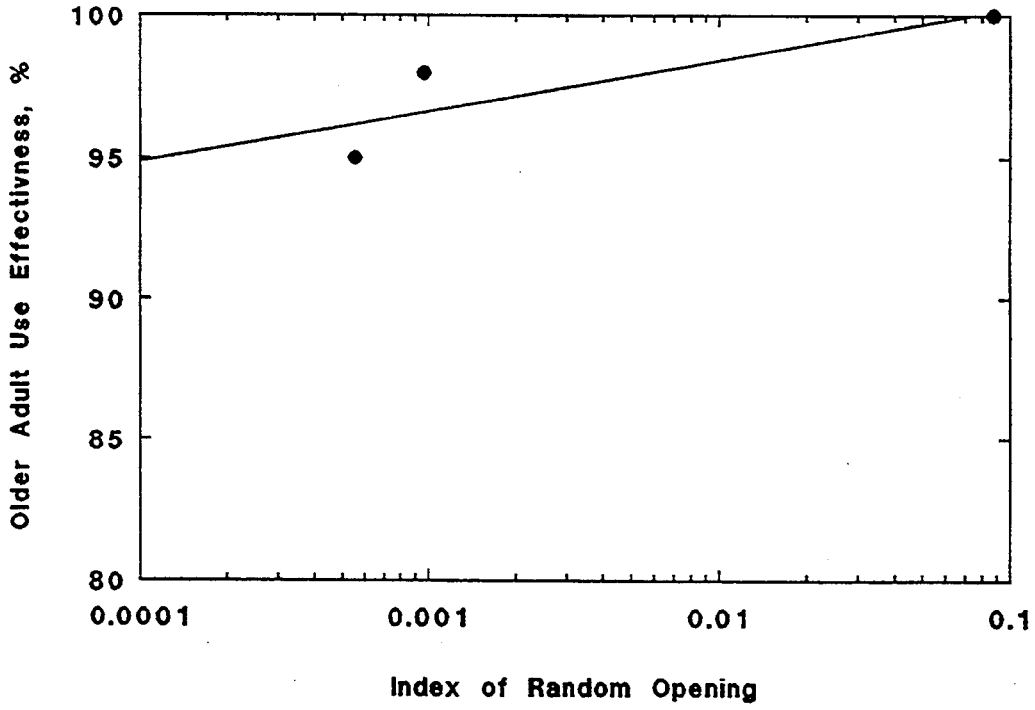
FIG. 12 is a graph which illustrates the correlation between IRO and OAUE.

While physical means such as FIGS. 11 and 12 may be used in the design process, a computer could also be programmed to output an appropriate IRO when a desired CRE and/or OAUE was input. Alternatively, algorithms derived from the correlations given on FIGS. 11 and 12 could be used to calculate an appropriate IRO given a selected CRE and/or OAUE.

In order to dimension a closure to render it child resistant in the manner disclosed herein, the first step is to select an appropriate (target) CRE. A minimum CRE may be mandated by government regulations as it is in the United States or it may be demanded by users. A second (optional) step is to select an appropriate (target) OAUE. This step may not be necessary in situations where OAUE is not required by government regulations or the marketplace.

Because the actual CRE and OAUE of CRP closures are measured by testing a sample of packages, as was noted above, statistical errors are associated with such measurements. For this reason, the selected (target) CRE or OAUE should be somewhat larger than the required CRE or OAUE.

The next step is to determine an IRO that correlates with at least the selected CRE and, optionally, with the selected OAUE. FIGS. 11 and 12 may be used in this determination in the absence of other data. For example, utilizing FIG. 11, the selected CRE of 80 percent yields an IRO of about 0.019.

The final step is to configure the combination lock mechanism to have the IRO determined in the prior step. With closures requiring rotations for unlocking, this may be accomplished by providing the closure an appropriate number of tumblers, each tumbler dimensioned in relation to the container to provide an appropriate "effective width" of channel in relation to the stud width and an appropriate interior circumference.

The design procedure is illustrated in the following example. In this example, a CRE of 85 percent and an OAUE of at least 95 percent are selected. These values are consistent with the current and proposed regulations of the CPSC. Utilizing FIG. 11, the CRE (read at the ordinate axis or y-axis) correlates with an IRO (read on the abscissa axis or x-axis) of 0.0016. Utilizing FIG. 12, the OAUE correlates with an IRO of at least 0.0001. Thus, an IRO of 0.0016 is determined.

An IRO of 0.0016 can be achieved with a closure design of the type illustrated in FIGS. 1–7. Review of the illustrated design indicates that while closure cap 20 can be rotated in either direction to align stud 36 with channel 22, closure cap 20 must be rotated in the opposite direction to align stud 38 with channel 21 if the previous alignment of stud 36 with channel 22 is to be maintained. Thus, the index that the first tumbler (rotatable member 30) could be randomly rotated in the correct direction is 1.0, but the index that the second tumbler (closure cap 20) could be randomly rotated in the correct direction is 0.5.

Many commercial snap-on type CRP closure caps incorporate a stud having a stud width (SW) of about 0.1875 inch. Two common CRP closure sizes are 33 millimeter (1.30 inches) and 38 millimeter (1.50 inches) in diameter. They are appropriate sizes for use on each neck rib on small containers having stepped ribs such as the container shown in FIGS. 1–7. If these closure sizes are used for the sizes of the closure cap and the rotatable members, the corresponding interior diameters of the first tumbler (rotatable member 30) is about 1.30 inches and the interior diameter of the second tumbler (closure cap 20) is about 1.50 inches. The corresponding interior circumferences of the tumblers (IC) are about 4.08 inches and about 4.71 inches, respectively. If a single channel is provided in each rib 16 and 18 and the channels are equal in width, then the index (I) that the center of each stud could be randomly placed within the "effective width" (EW) of each channel is:

$$I = EW/IC$$

where EW = TCW − SW (where TCW is total channel width)

With a single, common stud width (SW) of about 0.1875 inch on each tumbler and an IRO of 0.0016, an appropriate TCW is (if T=0):

| | |
|---|---|
| 0.0016 = | [(TCW − 0.1875)/(1.30*3.1416)]*1.0* [(TCW − 0.1875)/(1.50*3.1416)]*0.5 |
| or | |
| 0.0616 = | TCW − 0.1875 |
| or | |
| TCW = | 0.249 inch |

Thus, a combination lock closure mechanism of the type illustrated in FIGS. 1–7 configured with the above dimensions will have a CRE of about 85 percent and an OAUE of at least 95 percent.

For the purposes of this disclosure the term "effective width" of a channel means the difference between the width of a channel (e.g., channel 22) and the width of the stud (e.g., stud 36) that must be aligned with that channel. In the preferred mode, the "effective width" of channel 22 is wider than the effective width of channel 21. In this way, it is easier for a user with trembling hands to align stud 36 with channel 22 during the initial attempt to do so. The "effective width" of channel 21 can be relatively narrow because "searching" for this channel by the adult user is a practical option to precise alignment of stud 38 with channel 21.

Many variations of the invention will occur to those skilled in the art. All such variations within the scope of the claims are intended to be within the scope and spirit of the invention. For example, while the tumblers used in the examples disclosed herein have studs as fastening means, the procedure is also applicable to the alternative tumbler designs disclosed in the above-referenced patents. Furthermore, while the tumblers used in the examples disclosed herein are rotatable members, the method is also applicable to tumblers that are slidable members. The index of random opening for a closure similar in design to that shown in FIG. 1–7 but with two sets of channels (two channels of the same dimensions in each rib with each set located 180 degrees apart) is calculated using the following formula in accordance with the rationale presented previously:

$$IRO=([CW_i-SW_i)*2]/(\pi*D_i)*[(CW_oSW_o)*2)]/(\pi*D_o))*0.5$$

In this formula, $CW_i$ is the width of each of the two channels in the (top) rib that holds the rotatable member (inner cap) on the container, $SW_i$ is the width of the index stud on the inner cap, $D_i$ is the inside diameter of the inner cap, $CW_o$ is the width of each of the two channels in the (bottom) rib that holds the closure cap (outer cap) on the container, $SW_o$ is the width of the index stud on the outer cap and $D_o$ is the inside diameter of the outer cap. In an example with $CW_i=0.678$ inch, $SW_i=0.283$, $D_i=1.63$ inch, $CW_o=0.390$ inch, $SW_o=0.252$ inch and $D_o=1.75$ inch, the IRO is calculated as follows:

$$IRO=([(0.678-0.283)*2]/(3.1416*1.63)*[(0.390-0.252)*2]/(3.1416*1.75))*0.5=0.003872=1:260$$

INDUSTRIAL APPLICABILITY

The invention is capable of exploitation in industry as a closure for packaging of pharmaceutical products and toxic household chemicals. It can also be used to prevent access to the operating mechanism of child-resistant lighters and child-resistant safety belt buckles.

The closure parts may be fabricated using any conventional method. Thus, they may be fabricated by injection molding, blow molding, compression molding, transfer molding, casting, welding, machining, etc. As an example, the parts could initially be fabricated by injection molding and the channel effective widths modified by machining to dimension them so as to produce a selected width. Alternatively, the injection mold components used to form the parts could be initially machined to a "metal safe" condition to produce an initial version and then metal could be removed (to enlarge a stud width, for example) to produce a different channel effective width.

As another example, while the correlations presented in FIGS. 11 and 12 are appropriate for use at present with American children other correlations may be appropriate for other times and places. Those skilled in the art will see that simple experiments can be used to develop such correlations in other situations. For example, a CRP design similar to the embodiment disclosed in FIGS. 1–7 could be easily modified by gradually increasing the "effective width" of its channels (and, hence, by increasing its IRO) and then testing the modified embodiments on small groups of children and older adults using the CPSC test protocol. Each experiment would produce a point on correlation graphs such as FIGS. 11 and 12.

I claim:

1. A generally cylindrical relatively rotatable lock structure comprising:

a first member having at least a generally cylindrical portion, said generally cylindrical portion having an axis of rotation and an outer surface, said first member having connection means on said outer surface;

a second member having at least a generally cylindrical portion, said generally cylindrical portion having an axis of rotation and an inner surface and said generally cylindrical portion being coaxial with the cylindrical portion of said first member, said second member being rotatable relative to said first member about a common axis;

a third member having at least a generally cylindrical portion coaxial with the cylindrical portions of the first and second members and on one of which first and second members said third member is supported to prevent axial movement relative to the member that supports said third member but to permit a rotatable movement relative to the member that does not support said third member about said common axis subject to friction between the third member and said member that does not support said third member, such that the third member tends to rotate with said member that does not support said third member, the cylindrical portion of said third member having on a surface facing away from said member that supports said third member connection means cooperable with the connection means on the surface of said member that does not support said third member to prevent relative axial movement between said third member and said member that does not support said third member, except that in predetermined relatively rotatable positions axial movement of said third member relative to said member that does not support said third member is not prevented; and a first stop on said third member, said first stop having a stop face and another face, and a second stop on said member that supports said third member, said second stop having a stop face and another face, the stops limiting rotation of said third member relative to said member that supports said third member in one direction to less than one revolution before the stop faces abut, after which said third member is driven by the stops to rotate with said member that supports said third member, at least one of the stops having a ramp on the other face of said at least one of the stops of such pitch that the other stop, upon encountering said ramp, is able to ride up said ramp and over said at least one of the stops having a ramp whenever relative rotation is in a direction opposite to said one direction causing said stop faces to abut.

2. The lock structure of claim 1 in which said stop faces and said ramp are arranged so that a counterclockwise rotation of said second member as viewed from above with respect to said first member permits continuous rotation of said second member without causing said stop faces to abut, whereby said counterclockwise rotation of said second member relative to said first member that would normally be associated with unscrewing, if said lock structure were a conventional continuous threaded closure, is ineffective in causing said third member to rotate relative to said first member.

3. The lock structure of claim 1 in which said inner surface of said second member has connection means cooperative with the connection means on said outer surface of said first member to prevent relative axial movement between the first and second members except in predetermined relatively rotatable positions.

4. The lock structure of claim 1 in which said third member is inaccessible to direct manual manipulation.

5. The lock structure of claim 1 in which the stops on both said third member and said member that supports said third member are provided with opposed ramps to aid the stops in passing one another when rotation is in the direction opposite said one direction causing the stops faces to abut.

6. The lock structure of claim 1 in which said first member and said second member are a part of a container and a part of a closure thereof, respectively.

7. The lock structure of claim 1 further comprising a tamper detection device comprising:

in a combination comprising a closure cap part and a container part, said combination having an axis of rotation and requiring a rotational movement of said closure cap part relative to said container part about said axis of rotation for opening but said combination capable of being closed with an axial movement of said closure cap part relative to said container part;

a snap-off tab integral with one of the parts; and an obstruction integral with the other part of such size, strength, and position that upon rotation of said closure cap part relative to said container part wherein said snap-off tab moves by said obstruction, the tab will be snapped off so that absence of the tab will be readily detectable.

* * * * *